US006781136B1

(12) United States Patent
Kato

(10) Patent No.: US 6,781,136 B1
(45) Date of Patent: Aug. 24, 2004

(54) NEGATIVE ION EMITTING METHOD AND APPARATUS THEREFOR

(75) Inventor: Yoichi Kato, Tokyo (JP)

(73) Assignee: Lambda Co., Ltd., Tokyo (JP)

( * ) Notice: Subject to any disclaimer, the term of this patent is extended or adjusted under 35 U.S.C. 154(b) by 77 days.

(21) Appl. No.: 09/591,565

(22) Filed: Jun. 9, 2000

(30) Foreign Application Priority Data

Jun. 11, 1999 (JP) ..... 11-200752
Apr. 7, 2000 (JP) ..... 2000-107038

(51) Int. Cl.[7] ..... H05G 3/00; H01J 27/00
(52) U.S. Cl. ..... 250/423 R; 250/423 F; 250/324
(58) Field of Search ..... 250/423 R, 284, 250/306, 324, 493.1, 494.1, 423 F, 311; 313/146, 353, 355, 83; 414/217, 417

(56) References Cited

U.S. PATENT DOCUMENTS 3,617,740 A * 11/1971 Skillicorn ..... 250/49.5
3,742,423 A * 6/1973 Chadwick ..... 388/344
3,808,498 A * 4/1974 Fujisawa ..... 313/353
3,967,150 A * 6/1976 Lien et al. ..... 313/338
4,227,894 A 10/1980 Proynoff
4,531,077 A * 7/1985 Dagenhart ..... 315/111.81
4,591,753 A * 5/1986 Stoelinga ..... 313/146
4,847,476 A * 7/1989 Sato et al. ..... 250/427
4,911,737 A 3/1990 Yehl et al.
5,484,472 A 1/1996 Weinberg
5,536,944 A * 7/1996 Tsunoda et al. ..... 250/423 F
6,138,606 A * 10/2000 Ling ..... 118/723
6,653,638 B2 * 11/2003 Fujii ..... 250/423 R
2002/0130269 A1 * 9/2002 Fujii ..... 250/423 R

FOREIGN PATENT DOCUMENTS

| | | |
|---|---|---|
| JP | 629903 | 3/1987 |
| JP | 7153549 | 6/1995 |
| JP | 10208848 | 9/1997 |
| JP | 10199654 | 7/1998 |
| TW | 78202380 | 8/1991 |
| WO | 9203863 | 3/1992 |
| WO | 9216251 | 10/1992 |

* cited by examiner

*Primary Examiner*—John R. Lee
*Assistant Examiner*—David A. Vanore

(57) ABSTRACT

A negative ion emitting method and an apparatus therefor capable of emitting negative ions with increased efficiency without generating ozone and positive ions while being simplified in structure. The apparatus includes a DC high-voltage power supply section and a discharge electrode section, between which a load resistance section is arranged so as to restrict flowing of electrons from the power supply section to the discharge electrode section.

29 Claims, 7 Drawing Sheets

NEGATIVE ION EMITTING METHOD AND APPARATUS THEREFOR

BACKGROUND OF THE INVENTION

1. Field of the Invention

This invention relates to a negative ion emitting method and an apparatus therefor.

2. Description of the Related Art

A conventional negative ion emitting apparatus is generally constructed in such a manner that electrons or negative ions are emitted from a negative electrode set at a high voltage relative to a ground voltage to a positive electrode set at a high voltage. This is commonly called a corona discharge system.

Unfortunately, the corona discharge system has some important problems. One of the problems is that ozone is generated in air between the discharge electrodes due to the corona discharge. Another problem is that it causes generation of positive ions on a side of the positive electrode concurrently with generation of ozone.

Now, the conventional negative ion emitting apparatus will be described with reference to FIG. 9 together with a mechanism for absorbing ozone and positive ions. The conventional negative ion emitting apparatus includes a negative electrode 1 which is formed at a distal end thereof with an acute angle, as shown on a right side in FIG. 9. Also, it includes a positive electrode 9 of a cylindrical configuration arranged so as to receive negative ions emitted from the negative electrode. The positive electrode 9 is shown on a left side in FIG. 9. Reference numeral 2 designates an electrode support and 6 is a high-voltage power supply.

The conventional negative ion emitting apparatus further includes a first filter 10 arranged between the positive electrode 9 and the negative electrode 1. The first filter 10 has activated carbon incorporated therein, which functions to absorb ozone thereon, to thereby prevent ingress of ozone to the positive electrode 9.

The cylindrical positive electrode 9 is provided therein with a second filter 11 for absorbing positive ions generated due to the corona discharge thereon. To this end, the second filter 11 has a catalyst for absorbing positive ions added thereto.

The above-described construction of the conventional negative ion emitting apparatus permits ozone and positive ions thus generated to be effectively absorbed on the way to a negative ion storage section, so that only negative ions may be guided through the positive electrode 9 to the negative ion storage section.

Unfortunately, the above-described construction of the conventional negative ion emitting apparatus causes the apparatus to be complicated in structure and requires the above-described mechanism for absorbing ozone and positive ions. Also, the mechanism must be periodically replaced. In addition, the conventional negative ion emitting apparatus often causes neutralization of negative ions with positive ions on the way to the negative ion storage section, resulting in a failure to exhibit satisfactory efficiency.

SUMMARY OF THE INVENTION

The present invention has been made in view of the foregoing disadvantages of the prior art.

Accordingly, it is an object of the present invention to provide a negative ion emitting apparatus which is capable of effectively emitting electrons or negative ions without requiring any mechanism for absorbing ozone and positive ions.

It is another object of the present invention to provide a negative ion emitting method which is capable of effectively emitting electrons or negative ions without requiring any mechanism for absorbing ozone and positive ions.

In accordance with one aspect of the present invention, a negative ion emitting apparatus is provided. The negative ion emitting apparatus includes a DC high-voltage power supply section, at least one discharge electrode section, and at least one load resistance section arranged between the DC high-voltage power supply section and the discharge electrode section so as to restrict flowing of electrons from the DC high-voltage power supply section to the discharge electrode section.

In a preferred embodiment of the present invention, the DC high-voltage power supply section is connected to the load resistance section and discharge electrode section through a high-voltage wiring.

In a preferred embodiment of the present invention, the discharge electrode section is constituted by a needle electrode formed at a distal end thereof with an acute angle.

In a preferred embodiment of the present invention, the amount of negative ions emitted is varied by varying a load resistance of the load resistance section.

In a preferred embodiment of the present invention, a plurality of the discharge electrode sections are arranged, a distributor is arranged between the discharge electrode sections and the DC high-voltage power supply section and provided therein with an additional load resistance section, and the DC high-voltage power supply section and the discharge electrode sections are connected to the distributor.

In accordance with another aspect of the present invention, a negative ion emitting method is provided. The negative ion emitting method includes the step of connecting at least one load resistance section between a DC high-voltage power supply section and at least one discharge electrode section, to thereby restrict flowing of electrons from the DC high-voltage power supply section to the discharge electrode section for emission of negative ions from the discharge electrode section.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

A negative ion emitting apparatus according to the present invention will be described hereinafter with reference to the accompanying drawings.

Figure 1:
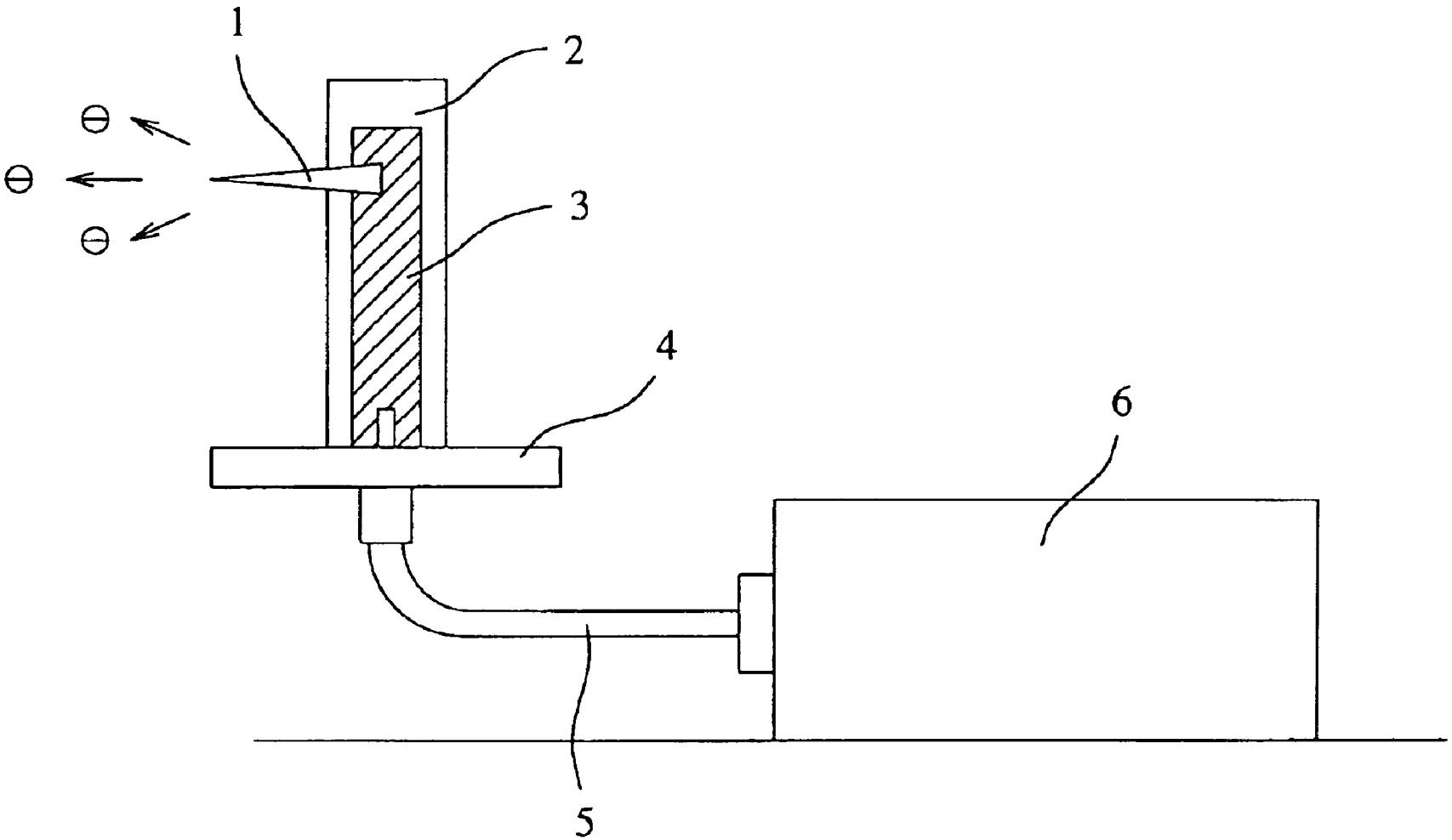
FIG. 1 is a side elevation view showing an embodiment of a negative ion emitting apparatus according to the present invention.

Referring first to FIG. 1, an embodiment of a negative ion emitting apparatus according to the present invention is illustrated. A negative ion emitting apparatus of the illustrated embodiment includes a needle electrode 1 acting as a discharge electrode section for emitting negatively charged electrons. The needle electrode 1 is made of a conductive metal material and pointed at a distal end thereof or formed at the distal end with an acute angle like a needle. The needle electrode 1 is supported in an electrode support 2 so that the distal end of the needle electrode 1 is outwardly projected from the electrode support 2. The electrode support 2 is made of an insulating material and formed to have a box-like configuration. The electrode support 2 has a Load resistance section 3 arranged therein and the needle electrode 1 is connected at a proximal end thereof to the load resistance section 3. The needle electrode 1 is preferably made of a conductive metal material such as titanium or the like which is harmless to the human body and hard to round at the distal end thereof by discharge. Titanium or the like may be suitably used for this purpose.

The load resistance section 3 is constructed so as to function as a pressure unit of a kind for blocking the flowing of electrons until a DC high voltage applied to the load resistance section 3 exceeds a predetermined limit level. The electrode support 2 may be made of, for example, a Derlin (trademark) or Teflon (trademark) material of a cylindrical shape and the load resistance section 3 may be made of, for example, carbon.

The electrode support 2 is securely mounted on a support base 4 using any suitable means. The load resistance section 3 is connected through a high-voltage wiring 5 to a DC high-voltage power supply section 6 constituted by a DC high-voltage power supply unit.

In the illustrated embodiment, a motor-driven fan (not shown) may be arranged behind the needle electrode 1, to thereby forcibly forwardly guide negative ions emitted from the needle electrode 1.

In the negative ion emitting apparatus of the illustrated embodiment thus constructed, when a high voltage is applied from the DC high-voltage power supply section 6 through the high-voltage wiring 5 toward the needle electrode 1, negatively charged electrons are apt to be directed through the high-voltage wiring 5 toward the needle electrode 1. However, the load resistance section 3 arranged between the needle electrode 1 and the high-voltage wiring 5 blocks flowing of the electrons to the needle electrode 1.

Thus, the negatively charged electrons are filled in the wiring 5 before the load resistance section 3 due to the blocking by the load resistance section 3. When, the DC high-voltage applied exceeds a predetermined limit level, it forcibly expels the electrons through the load resistance section 3 to the needle electrode 1, so that the electrons or negative ions may be emitted from the needle electrode 1.

The atmospheric air constantly contains moisture in an amount of about 30%. This results in hydrogen ions (positive ions) in the moisture always floating in the air. In addition to the hydrogen ions, a variety of other positive ions are likewise present in the air. Presence of such positive ions in the air permits the air to be regarded as a virtual positive electrode, so that discharge might occur in the air. In this instance, the above-described construction of the illustrated embodiment permits an impedance of the load resistance section 3 to be increased as compared with that between the virtual positive electrode and the needle electrode 1, leading to emission of electrons or negative ions from the needle electrode 1.

Such emission of electrons or negative ions from the needle electrode 1 requires matching between a power voltage of the high-voltage power supply section 6 and a resistance of the load resistance section 3. For example, setting of a power supply of the high-voltage power supply and a resistance of the load resistance section at 5 kV and 20 Ω leads to emission of negative ions from the needle electrode 1. Such emission of negative ions from the negative ion emitting apparatus of the illustrated embodiment was confirmed by luminescence of a fluorescent tube obtained due to approaching of the apparatus to the fluorescent tube.

Figure 2:
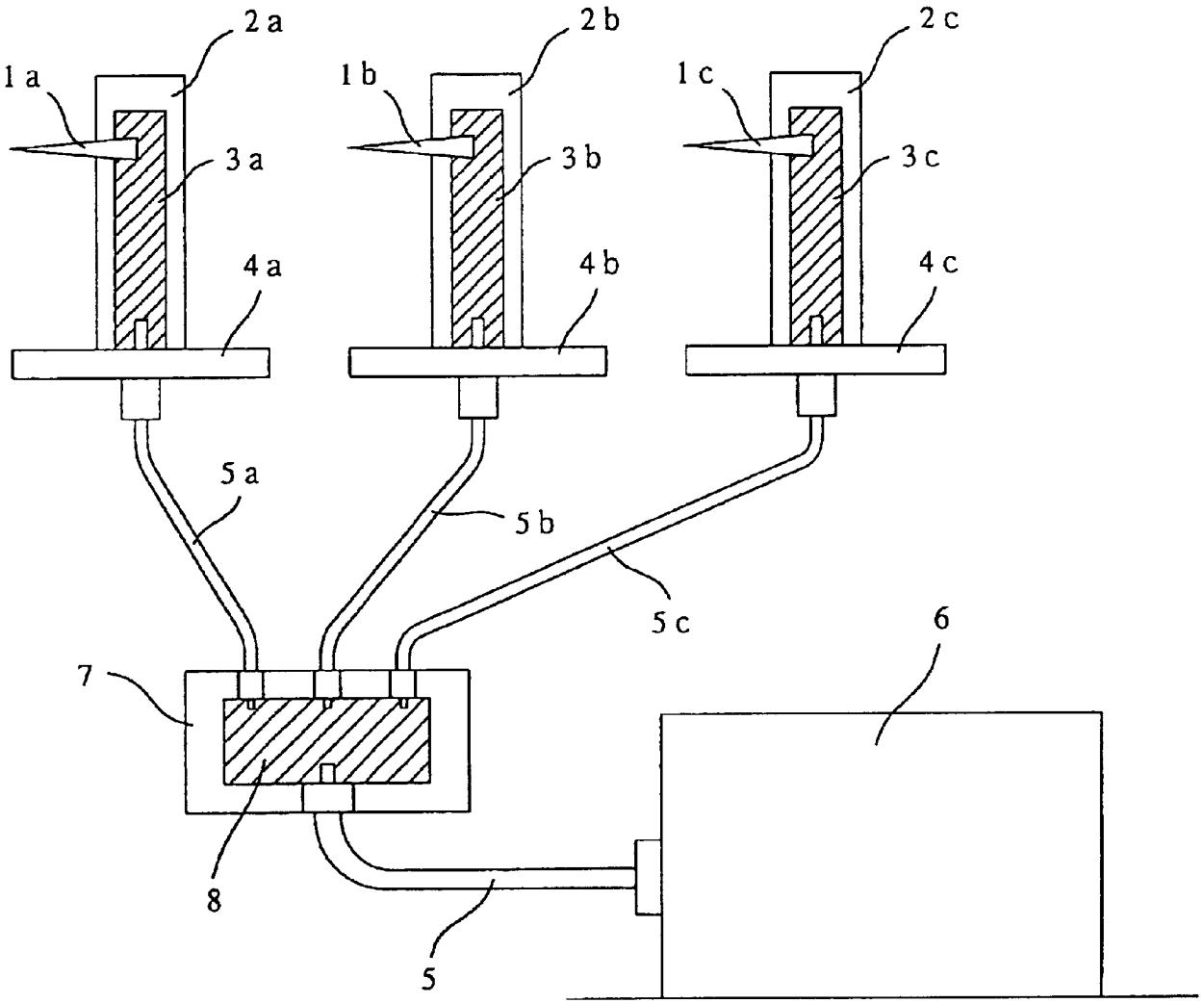
FIG. 2 is a side elevation view showing another embodiment of a negative ion emitting apparatus according to the present invention.

Referring now to FIG. 2, another embodiment of a negative ion emitting apparatus according to the present invention is illustrated. A negative ion emitting apparatus of the illustrated embodiment includes three needle electrodes 1*a*, 1*b* and 1*c*, electrode supports 2*a*, 2*b* and 2*c* in which the needle In electrodes 1*a*, 1*b* and 1*c* are arranged and which have load resistance sections 3*a*, 3*b* and 3*c* arranged therein, respectively, and support bases 4*a*, 4*b* and 4*c* for supporting the electrode supports 2*a*, 2*b* and 2*c* thereon. The needle electrodes 1*a*, 1*b* and 1*c* are connected through a common distributor 7 to a common high-voltage power supply section 6. The needle electrodes 1*a*, 1*b* and 1*c* are connected through high-voltage wirings 5*a*, 5*b* and 5*c* to the distributor 7. The distributor 7 and high-voltage power supply section 6 are connected to each other through a single high-voltage wiring 5.

In the illustrated embodiment, the respective three needle electrodes, electrode supports, support bases and high-voltage wirings are arranged. However, they are not limited to such number. Thus, the respective two or four components may be arranged.

The distributor 7 includes a housing made of an insulating material and has a load resistance section 8 arranged therein. The load resistance section 8 may be constructed in the same manner as the load resistance sections 3a to 3c. The high-voltage wiring 5 and high-voltage wirings 5*a* to 5*c* are connected to each other through the load resistance section 8. The load resistance section 8 functions to block flowing of negatively charged electrons from the high-voltage power supply section 6 thereto and equalize distribution of electrons to the needle electrodes 1*a* to 1*c*, to thereby permit the needle electrodes 1*a* to 1*c* to equally emit electrons or negative ions.

In the negative ion emitting apparatus of the illustrated embodiment thus constructed, when the DC high-voltage power supply section 6 is activated for application of a high voltage, it discharges negatively charged electrons. However, the negatively charged electrons are prevented from flowing through the high-voltage wiring 5 to the load resistance section 8 arranged between the high-voltage wiring 5 and the high-voltage wirings 5*a* to 5*c* by the load resistance section 8.

This results in the negatively charged electrons being filled in the wiring 5, thus, it will be noted that the load resistance section 8 acts as a pressure unit of a kind. When, the high-voltage applied exceeds a predetermined level, the load resistance section 8 tries to forcibly discharge the filled negatively charged electrons through the high-voltage wirings 5*a* to 5*c* toward the needle electrodes while equally distributing the negatively charged electrons to the wirings. However, the negatively charged electrons are prevented from flowing to the needle electrodes 1*a*, 1*b* and 1*c* by the lead resistance sections 3*a*, 3*b* and 3*c* respectively arranged between the high-voltage wirings 5*a*, 5*b* and 5*c* and the needle electrodes 1*a*, 1*b* and 1*c*.

This causes negatively charged electrons to be filled in the high-voltage wirings 5*a* to 5*c*. Then, when filling of the negatively charged electrons in the wirings exceeds a predetermined level, the electrons are forcibly equally distributed to the needle electrodes 1*a*, 1*b* and 1*c*, which are then equally emitted from the needle electrodes 1*a*, 1*b* and 1*c*, respectively.

As described above; the negative ion emitting apparatus of the present invention is so constructed that at least one load resistance section is connected between the DC high-voltage power supply section and at least one discharge electrode section to restrict flowing of electrons, leading to emission of negative ions. Such construction permits generation of negative ions without requiring any positive electrode. Thus, the present invention effectively eliminates generation of ozone due to corona discharge and generation of positive ions and by-products by a positive electrode, resulting in a structure of the negative ion emitting apparatus of the present invention being simplified and maintenance thereof being facilitated. Also, the present invention is increased in efficiency of emission of negative ions.

The present invention will be more readily understood with reference to the following example; however, these examples are intended to illustrate the invention and not to be constructed to limit the scope of the invention.

EXAMPLE 1

The negative ion emitting apparatus of the present invention constructed as shown in FIG. 1 was used in the example, wherein the DC high-voltage power supply section was constituted by a high-pressure power supply manufactured by Logy Denshi Kabushiki Kaisha and the needle electrode was made of titanium. A voltage at the high-voltage power supply section and a resistance of the load resistance section were set to be 5 kv and 20 Ω, respectively, resulting in negative ions emitted from the needle electrode being measured.

The measurement was carried out using ion system measuring equipment commercially available under a tradename MODEL KST-900 from Kobe Denpa Kabushiki Kaisha. The measuring conditions were as follows:

Ions measured: Positive and negative ions, Mobility: 0.4 $cm^2/V\cdot sec$ or more Space charge density: Difference between the number of positive ions and that of negative ions in the total number of ions Environment for measurement: Environment in a normal atmospheric air or environment containing ions in high concentration generated in atmospheric air Measurement range: 5 to 999900 ions/cc Minimum resolution in measurement: 5 ions/cc Flow rate during sampling: 60 1/min Measurement place: Meeting room, Kobe Denpa Kabushiki Kaisha Measurement temperature: Room temperature (21° C.)

Figure 3:
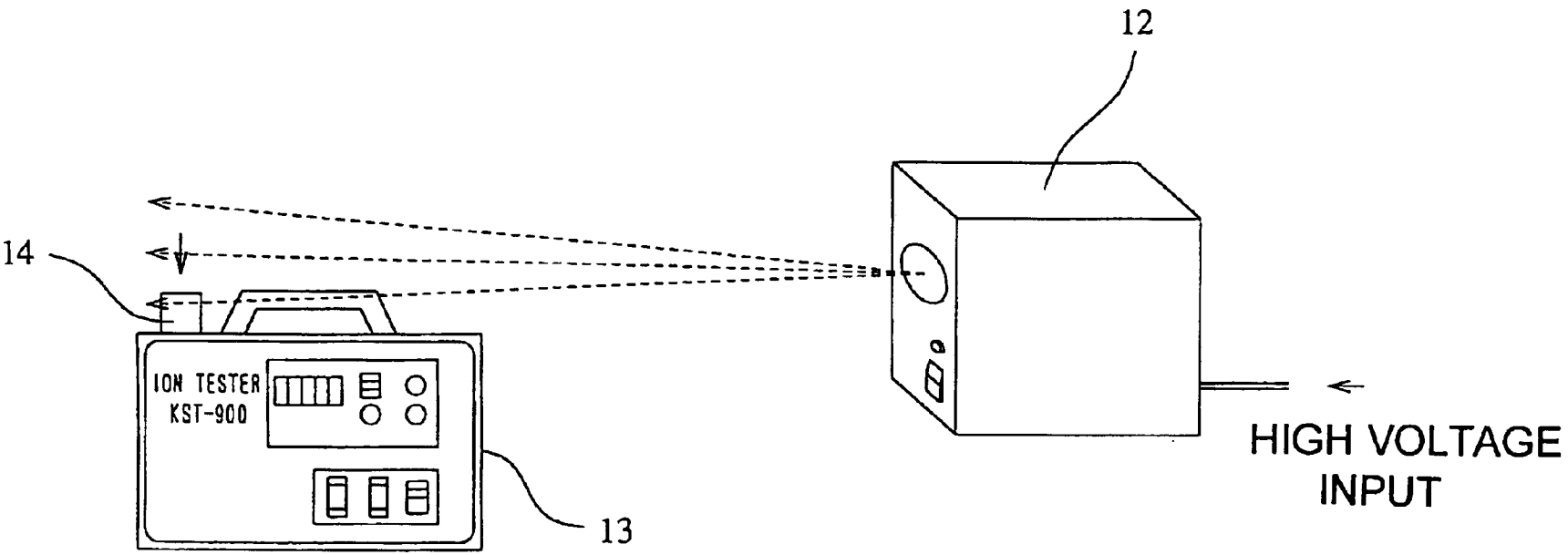
FIG. 3 is a schematic view showing measurement of negative ions emitted from the negative ion emitting apparatus according to the present invention.

The measurement was carried out as shown in FIG. 3. More specifically, the measurement equipment 13 described above was placed at a location spaced by 1 m from the negative ion emitting apparatus 12. The measurement equipment 13 was arranged so as to permit ions to pass above a sampling inlet 14 of the equipment 13. The measurement was carried out about 300 times for five minutes from each of times 14:45, 15:00, 15:15 and 15:35, after actuation of the negative ion emitting device 12 was started.

Figure 4:
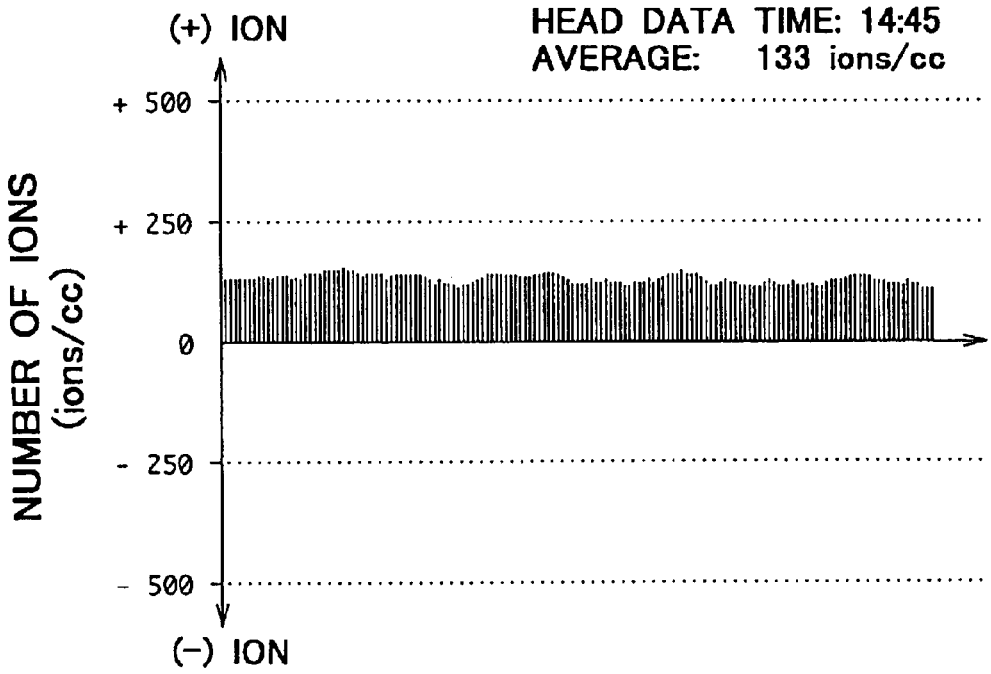
FIGS. 4 to 7 each are a graphical representation showing results of the measurement in FIG. 3.
Figure 5:
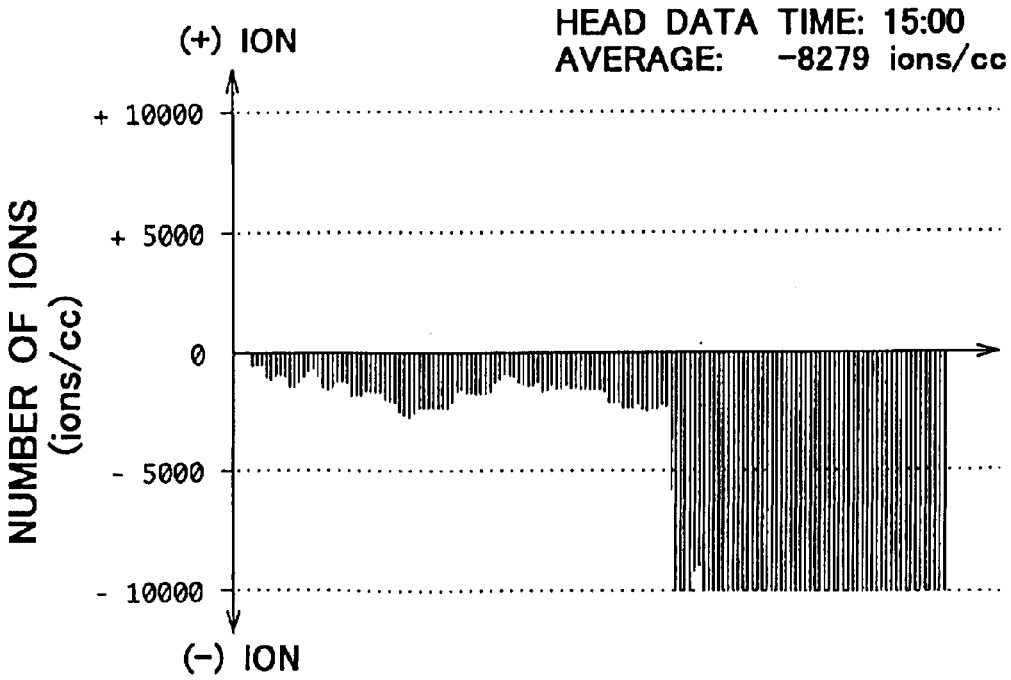
Figure 6:
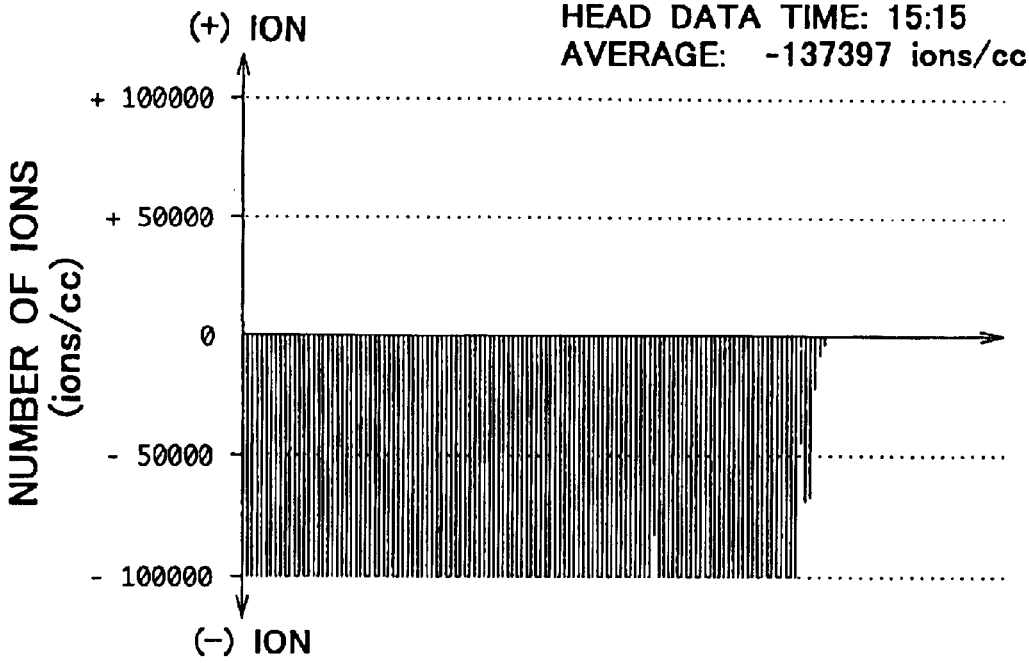
Figure 7:
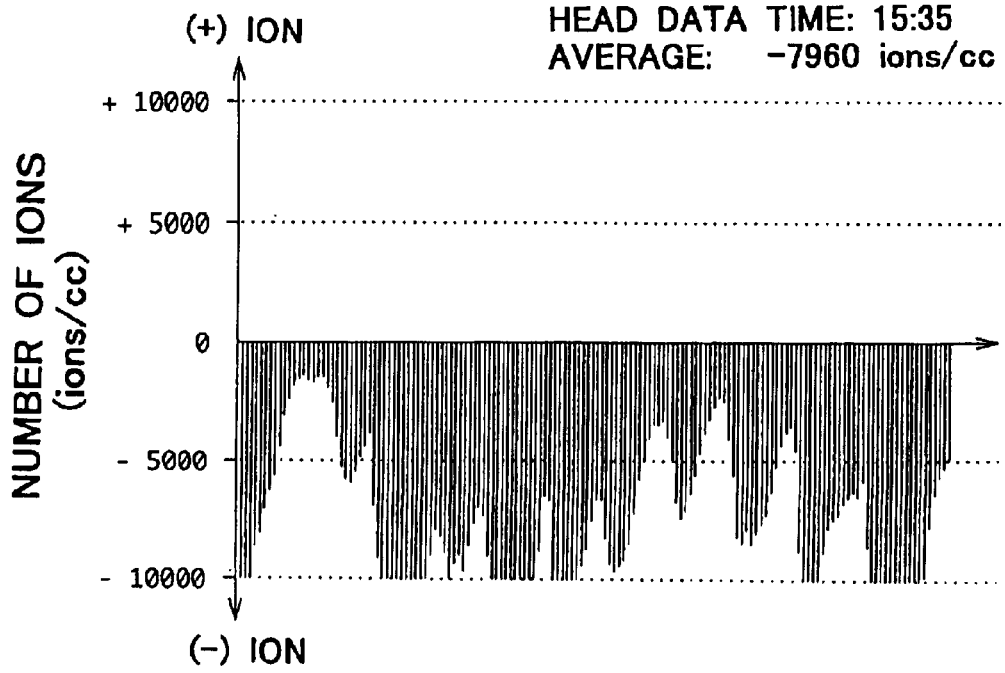

The results are shown in FIGS. 4, 5, 6 and 7, wherein FIG. 4 shows data on measurement of positive ions obtained when the measurement was started at time 14:45. Measurement of positive ions took place for the reason that presence of positive ions in the atmospheric air before the measurement causes the positive ions to be bonded to negative ions emitted from the negative ion emitting apparatus, leading to a failure in grasping the number of negative ions actually emitted. A reduction in the number of negative ions at an initial stage of the measurement in FIG. 5 would be due to the fact that negative ions bonded to positive ions fail to be counted.

The number of negative ions counted, the number of times of measurement and an average thereof were as follows:

| | |
|---|---|
| (1) Start of measurement at 15:00 (the maximum value is not shown in FIG. 5): | |
| 10000 to 20000 ions/cc: | 49 times |
| 20000 to 30000 ions/cc: | 60 times |
| Average: 8279 ions/cc | |
| (2) Start of measurement at 15:15 (shown in FIG. 6): | |
| 0 to 100000 ions/cc: | 18 times |
| 100000 to 120000 ions/cc: | 28 times |
| 120000 to 140000 ions/cc: | 74 times |
| 140000 to 160000 ions/cc: | 58 times |
| 160000 to 180000 ions/cc: | 76 times |
| Average: 137397 ions/cc | |
| (3) Start of measurement at 15:35 (shown in FIG. 7) | |
| 1000 to 5000 ions/cc: | 70 times |
| 5000 to 10000 ions/cc: | 144 times |
| 10000 to 12000 ions/cc: | 46 times |
| 12000 to 14000 ions/cc: | 28 times |
| 14000 to 20000 ions/cc: | 14 times |
| Average: 7960 ions/cc | |

A variation in numerical value during the measurement would be due to entrance and departure of people with respect to the meeting room in which the measurement was carried out during the measurement.

The above results clearly prove that the negative electron emitting apparatus of the present invention can emit a considerable number of negative ions.

EXAMPLE 2

In order to compare the amount of each of positive ions and ozone emitted from the needle electrode of the negative ion emitting apparatus of the present invention used in Example 1 with that emitted from a conventional negative ion emitting apparatus utilizing corona discharge (manufactured by a certain manufacturer in Japan), the inventors requested Oki Engineering Co., Ltd. (Measurement Verifier Registration No. 595/Tokyo) to make the measurement.

Positive ions emitted cause nitrogen and oxygen in the air to be bonded to each other to produce nitrogen oxides. Thus, in the example, nitrogen oxides were measured.

Figure 8:
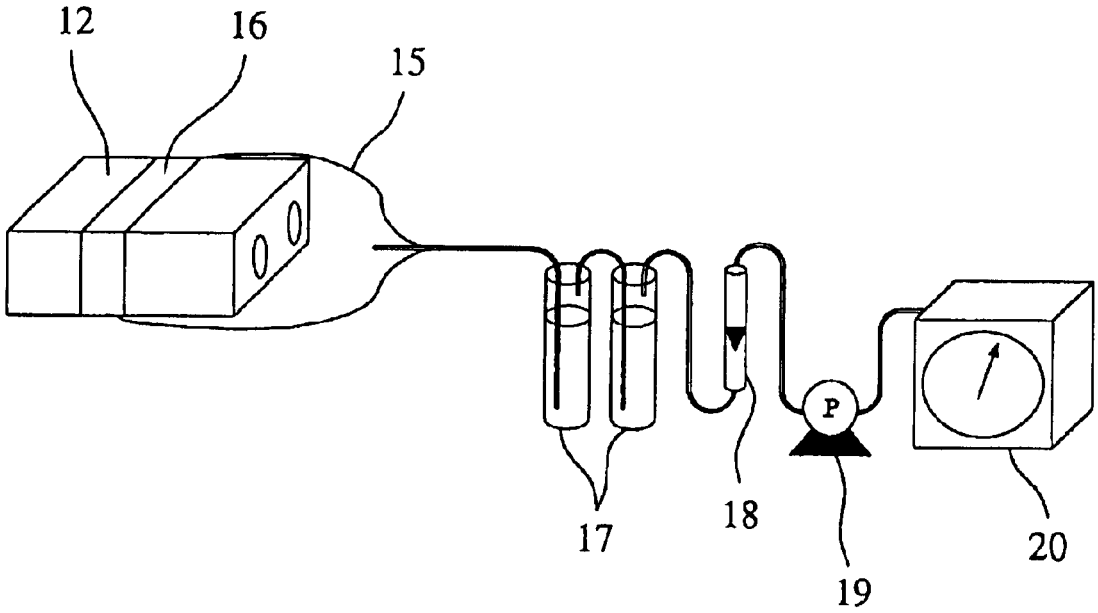
FIG. 8 is a schematic view showing sampling of gas generated from each of the negative ion emitting apparatus of the present invention and a conventional air cleaner.
Figure 9:
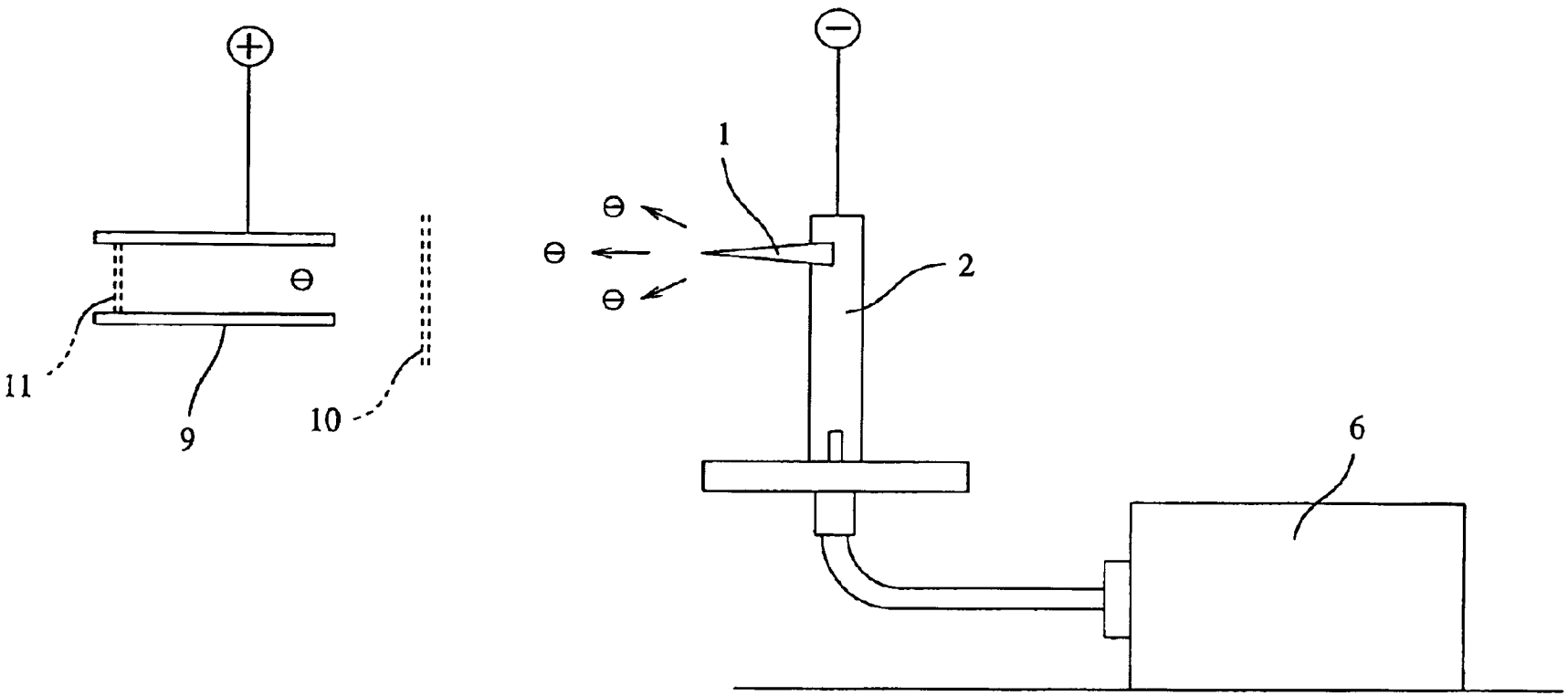
FIG. 9 PRIOR ART
FIG. 9 is a side elevation view showing a conventional negative ion emitting apparatus.

The measurement was carried out as follows:

Sampling of gas generated from the negative ion emitting apparatus was carried out as shown in FIG. 8. More specifically, the negative ion emitting apparatus 12 was kept at a rear portion thereof open and covered on a front side thereof or a negative ion generation side thereof with a vinyl sheet 15, followed by sealing of the apparatus 12 by means of an adhesive tape to prevent leakage from the apparatus. Then, the vinyl sheet 15 was pursed up at a distal end thereof and a Teflon tube was securely connected to the distal end of the sheet 15 by means of an adhesive tape, to thereby permit a distal end of the tube to act as a sampling port. Then, two or first and second musette impingers 17 arranged in series, a flow meter 18, a diaphragm pump 19 and an integrating flow meter 20 were connected to the apparatus in order. Sampling of gas generated from the apparatus was carried out for 20 minutes.

Measurement of nitrogen oxides took place using ion chromatography. More specifically, 10 ml of 0.3% hydrogen peroxide aqueous solution was used as a collecting liquid. Nitrogen monoxide and nitrogen dioxide were oxidized to a nitrite ion and a nitrate ion in the collecting liquid, resulting in being collected therein. Then, the nitrite ion and nitrate ion thus collected were subjected to quantitative determination by ion chromatography. Concurrently, nitrite and nitrate ions in the room were likewise determined (reference test) according to substantially the same procedure as described above. The latter measured values were subtracted from the former ones, to thereby calculate the amount of nitrogen oxides generated from the apparatus per unit time. In a hydrogen peroxide aqueous solution, a nitrite ion or nitrate ion in an amount of one mole is produced per mole of nitrogen monoxide or nitrogen dioxide. A mole of gas occupies a volume of 22.4 l at a temperature 0° C. and a pressure of 10.3 kPa, so that the amount of nitrogen oxides generated per unit time is equal to a sum of a determined value of a nitrite ion and that of a nitrate ion.

Measurement of nitrite and nitrate ions in the collecting liquid was carried out using an ion chromatograph commercially available under a tradename IC7000P (temperature of constant temperature bath: 40° C., column: ICS-A44, eluting solution: 4.0 mmol $Na_2CO_3$/4.0 mmol $NaHCO_3$, removing solution: 15 mol $H_2SO_4$) from YOKOGAWA ELECTRIC CORP.

The results of measurement of a volume of nitrogen oxides generated per unit time carried out as described above are as follows:

| | |
|---|---|
| Negative ion emitting apparatus of the present invention | below 2 μl/h |
| Conventional air cleaner | 48 μl/h |

Ozone was measured using neutral potassium iodide techniques. More particularly, 13.61 g of $KH_2PO_4$, 35.82 g of $Na_2HPO_4$ and 10.0 g of KI were dissolved in water to prepare an aqueous solution of 800 ml in volume and then a NaOH solution and a HCl solution were added to the solution to adjust pH of the solution to a level of 6.8 to 7.2. Then, water was added to the solution, to thereby obtain the solution of 1000 ml in volume, which was used as a collecting solution. Also, 0.1 mol/l $I_2$ solution of 10 ml in volume was prepared and HCL was added thereto, and the solution was titrated with 0.05 mol/l of $Na_2S_2O_3$ solution using starch as an indicator. Supposing that a titration value thus obtained is indicated at a ml, 0.1 mol/l of $I_2$ solution was taken in a volume of 89.3/(a×f) ml (f: a factor of 0.05 mol/l $Na_2S_2O_3$ solution) and then water was added to the solution to obtain the solution of 100 ml in volume. Then, the solution was diluted to a concentration as large as one tenth with the collecting solution, to thereby obtain a standard solution.

Then, 10 ml of the collecting liquid was placed in each of the first and second musette impingers 17 shown in FIG. 8 and then an air sample was passed through the impingers for a predetermined period of time (10 to 30 minutes) at a suction speed of about 2 l/min. After passing of the air sample therethrough, water was added to the collecting liquid to increase a volume of the collecting liquid to 10 ml, to thereby obtain a test solution of 10 ml. Within 45 to 60 minutes after sampling, the test solution and standard solution each were stepwise diluted with the collecting liquid and then subjected to measurement of absorbance at a maximum wavelength near 350 nm, to thereby prepare a calibration curve (relational curve). Then, the amount of ozone ($O_3$) was obtained from the calibration curve, resulting in the amount of $O_3$ generated per unit time being calculated.

The absorbance measurement was carried out using a commercially available visible spectrophotometer (UV 2000, absorption wavelength: 350 nm) manufactured by Shimadzu Corp.

The results of measurement of a volume of ozone per unit time are as follows:

| | |
|---|---|
| Negative ion emitting apparatus of the present invention | below 2 μl/h |
| Conventional air cleaner | 48 μl/h |

The results clearly indicates that the negative ion emitting apparatus of the present invention generates only a trace amount of positive ions and ozone, which are not substantially detected.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A negative ion emitting apparatus comprising:

a DC high-voltage power supply section;

at least one discharge electrode section connected to the DC high-voltage power supply section for emitting negatively charged electrons, the discharge electrode section having a proximal end and a distal end, the distal end of the discharge electrode section being exposed to air; and at least one load resistance section arranged between said DC high-voltage power supply section and said discharge electrode section so as to restrict the flow of electrons from said DC high-voltage power supply section to said discharge electrode section until a predetermined voltage is applied, wherein the discharge electrode section is operatively connected at a proximal end to a load resistance section so that current flows from the DC high-voltage power supply section through the load resistance section to the proximal end of each discharge electrode section causing negatively charged electrons to be emitted from a distal end of the discharge electrode section into the air.

2. A negative ion emitting apparatus as defined in claim 1, wherein said DC high-voltage power supply section is connected to said load resistance section and discharge electrode section through a high-voltage wiring.

3. A negative ion emitting apparatus as defined in claim 1, wherein said discharge electrode section is constituted by a needle electrode which is formed to be pointed at the distal end thereof with an acute angle to a longitudinal axis of the needle electrode.

4. A negative ion emitting apparatus as defined in claim 2, wherein said discharge electrode section is constituted by a needle electrode.

5. A negative ion emitting apparatus as defined in claim 1, wherein the amount of negative ions emitted is varied by varying a load resistance of said load resistance section.

6. A negative ion emitting apparatus as defined in claim 2, wherein the amount of negative ions emitted is varied by varying a load resistance of said load resistance section.

7. A negative ion emitting apparatus as defined in claim 3, wherein the amount of negative ions emitted is varied by varying a load resistance of said load resistance section.

8. A negative ion emitting apparatus as defined in claim 4, wherein the amount of negative ions emitted is varied by varying a load resistance of said load resistance section.

9. A negative ion emitting apparatus as defined in claim 1, wherein a plurality of said discharge electrode sections are arranged;

a distributor is arranged between said discharge electrode sections and said DC high-voltage power supply section and provided therein with an additional load resistance section; and said DC high-voltage power supply section and said discharge electrode sections are connected to said distributor.

10. A negative ion emitting apparatus as defined in claim 2, wherein a plurality of said discharge electrode sections are arranged;

a distributor is arranged between said discharge electrode sections and said DC high-voltage power supply section and provided therein with an additional load resistance section; and said DC high-voltage power supply section and said discharge electrode sections are connected to said distributor.

11. A negative ion emitting apparatus as defined in claim 3, wherein a plurality of said discharge electrode sections are arranged;

a distributor is arranged between said discharge electrode sections and said DC high-voltage power supply section and provided therein with an additional load resistance section; and said DC high-voltage power supply section and said discharge electrode sections are connected to said distributor.

12. A negative ion emitting apparatus as defined in claim 4, wherein a plurality of said discharge electrode sections are arranged;

a distributor is arranged between said discharge electrode sections and said DC high-voltage power supply section and provided therein with an additional load resistance section; and said DC high-voltage power supply section and said discharge electrode sections are connected to said distributor.

13. A negative ion emitting apparatus as defined in claim 5, wherein a plurality of said discharge electrode sections are arranged;

a distributor is arranged between said discharge electrode sections and said DC high-voltage power supply section and provided therein with an additional load resistance section; and said DC high-voltage power supply section and said discharge electrode sections are connected to said distributor.

14. A negative ion emitting apparatus as defined in claim 6, wherein a plurality of said discharge electrode sections are arranged;

a distributor is arranged between said discharge electrode sections and said DC high-voltage power supply section and provided therein with an additional load resistance section; and said DC high-voltage power supply section and said discharge electrode sections are connected to said distributor.

15. A negative ion emitting apparatus as defined in claim 7, wherein a plurality of said discharge electrode sections are arranged;

a distributor is arranged between said discharge electrode sections and said DC high-voltage power supply section and provided therein with an additional load resistance section; and said DC high-voltage power supply section and said discharge electrode sections are connected to said distributor.

16. A negative ion emitting apparatus as defined in claim 8, wherein a plurality of said discharge electrode sections are arranged;

a distributor is arranged between said discharge electrode sections and said DC high-voltage power supply section and provided therein with an additional load resistance section; and said DC high-voltage power supply section and said discharge electrode sections are connected to said distributor.

17. A negative ion emitting method comprising the step of connecting at least one load resistance section between a DC high-voltage power supply section and at least one discharge electrode section having a proximal end and a distal end, the distal end being exposed to air, the load resistance section thereby restricting the flow of electrons from said DC high-voltage power supply section to said discharge electrode section for enabling an emission of negative ions from said discharge electrode section, wherein said discharge electrode section is operatively connected at a proximal end to said load resistance section so that current flows from said DC high-voltage power supply section through said load resistance section to the proximal end of said discharge electrode section causing negatively charged electrons to be emitted from the distal end of said discharge electrode section into the air.

18. A negative ion emitting apparatus as in claim 3 wherein the load resistance section includes carbon having a resistance of 20 Ω and the DC high-voltage power supply section to provide 5 kV.

19. A negative ion emitting apparatus as in claim 9 wherein the load resistance section is carbon in each of said discharge electrode sections and the additional load resistance section in the distributor is carbon.

20. A negative ion emitting apparatus as in claim 19 wherein the respective carbon sections have a resistance of 20 Ω and the DC high-voltage power supply section provides 5 kV.

21. A negative ion emitting apparatus comprising:

a DC high-voltage power supply section;

a first needle point metal electrode for emitting negative ions, a predetermined portion of the first needle point metal electrode being exposed to air; and a first load resistance section including carbon of approximately 20 Ω connecting the DC high-voltage power supply section to limit the first needle point metal electrode from emitting negative ions until a predetermined voltage is applied by the DC high-voltage power supply section, whereby at the predetermined voltage the negative ions are forcibly emitted from the predetermined portion of the first needle point metal electrode into the air.

22. A negative ion emitting apparatus as in claim 21 wherein a second needle point metal electrode and a second load resistance section including carbon is connected to the DC high-voltage power supply section and a common load resistance section is connected to the respective first and second load resistance sections in series with the DC high-voltage power supply section.

23. The negative ion emitting apparatus of claim 1, wherein the air comprises a virtual positive electrode.

24. The negative ion emitting apparatus of claim 23, wherein the load resistance section has an impedance that is higher than the impedance between the virtual positive electrode and the at least one discharge electrode section causing negatively charged electrons to be emitted from the at least one discharge electrode section.

25. The negative ion emitting method of claim 17, wherein the air comprises a virtual positive electrode.

26. The negative ion emitting method of claim 25, wherein the load resistance section has an impedance that is higher than the impedance between the virtual positive electrode and the discharge electrode section causing negatively charged electrons to be emitted from the discharge electrode section.

27. The negative ion emitting apparatus of claim 21, wherein the air comprises a virtual positive electrode.

28. The negative ion emitting apparatus of claim 27, wherein the load resistance section has an impedance that is higher than the impedance between the virtual positive electrode and the predetermined portion of the first needle point metal electrode causing negatively ions to be emitted from the predetermined portion of the first needle point metal electrode.

29. A negative ion emitting system, comprising:

a direct-current high-voltage power supply section for supplying a source of electrons;

a supply of air;

at least one discharge electrode section connected to the direct-current (DC) high-voltage power supply section for emitting electrons, the discharge electrode section having a proximal end and a distal end, the distal end of the discharge electrode section being exposed to the air, the air operatively functioning as a virtual positive electrode; and at least one load resistance section arranged between the DC high-voltage power supply section and the discharge electrode section so as to restrict the flow of electrons from the DC high-voltage power supply section to the discharge electrode section until a predetermined voltage is applied, wherein the discharge electrode section is operatively connected at a proximal end to a load resistance section so that current flows from the DC high-voltage power supply section through the load resistance section to the proximal end of each discharge electrode section causing electrons to be emitted from a distal end of the discharge electrode section into the air, and wherein the load resistance section has an impedance that is higher than the impedance between the virtual positive electrode and the at least one discharge electrode section causing negatively charged electrons to be emitted from the at least one discharge electrode section.

* * * * *